US006907998B2

(12) United States Patent
Deiss

(10) Patent No.: US 6,907,998 B2
(45) Date of Patent: Jun. 21, 2005

(54) DISH RACK FOR ACCOMMODATING DISHES, AND HOUSEHOLD DISHWASHER

(75) Inventor: Ulrich Deiss, Sontheim (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 09/878,665

(22) Filed: Jun. 11, 2001

(65) Prior Publication Data

US 2001/0045401 A1 Nov. 29, 2001

Related U.S. Application Data

(63) Continuation of application No. PCT/EP99/09162, filed on Dec. 7, 1999.

(30) Foreign Application Priority Data

Dec. 10, 1998 (DE) ..... 198 57 104

(51) Int. Cl.[7] ..... A47G 19/08
(52) U.S. Cl. ..... 211/41.8; 211/181.1
(58) Field of Search ..... 211/41.8, 41.4, 211/41.9, 41.7, 181.1

(56) References Cited

U.S. PATENT DOCUMENTS

| | | | | |
|---|---|---|---|---|
| 2,516,088 A | * | 7/1950 | Einhorn | 211/41.1 |
| 2,841,288 A | * | 7/1958 | Field et al. | 211/41.1 |
| 3,612,285 A | * | 10/1971 | Mason | 211/41.1 |
| 3,752,322 A | * | 8/1973 | Fiocca et al. | 211/41.8 |
| 4,238,035 A | * | 12/1980 | Kassanchuk | 211/74 |
| 4,606,464 A | | 8/1986 | Jordan et al. | |
| 5,158,185 A | | 10/1992 | Michael et al. | |
| 5,344,029 A | * | 9/1994 | Oghia et al. | 211/41.8 |
| 5,497,890 A | * | 3/1996 | Clark | 211/41.8 |
| 5,626,242 A | * | 5/1997 | Weizer | 211/94.01 |
| 5,649,630 A | * | 7/1997 | Remmler | 211/41.8 |

FOREIGN PATENT DOCUMENTS

| | | |
|---|---|---|
| DE | 1 960 802 | 11/1966 |
| DE | 88 11 474.0 U1 | 12/1988 |
| DE | 44 37 472 A1 | 4/1996 |
| DE | 297 22 001 U1 | 3/1998 |
| DE | 296 18 924 U1 | 4/1998 |
| EP | 0 729 725 A1 | 9/1996 |

* cited by examiner

*Primary Examiner*—Anita King
*Assistant Examiner*—Khoa Tran
(74) *Attorney, Agent, or Firm*—Laurence A. Greenberg; Werner H. Stemer; Ralph E. Locher

(57) ABSTRACT

A dish rack for accommodating dishes, particularly in a household dishwasher, includes a dish rack base having a rake-like retaining configuration with prongs. At least part of the rake-like retaining configuration is pivotable between different pivot positions. Some of the prongs have angled ends directed toward or adjacent the dish-rack base, the angled ends forming a set-down surface for dishes, in particular, hollow dishes such as glasses, vases, cups, and bowls, when the retaining configuration is pivoted.

17 Claims, 2 Drawing Sheets

1
2
3
4
7'
9

DISH RACK FOR ACCOMMODATING DISHES, AND HOUSEHOLD DISHWASHER

CROSS-REFERENCE TO RELATED APPLICATION

This application is a continuation of copending International Application No. PCT/EP99/09612, filed Dec. 7, 1999, which designated the United States.

BACKGROUND OF THE INVENTION

Field of the Invention

The invention lies in the field of appliances. The invention relates to a dish rack for accommodating dishes, in particular, in a household dishwasher, having a rake-like retaining configuration that includes a plurality of prongs and can be swung between different pivot positions, and to a household dishwasher.

In general, the prior art uses dish racks for accommodating dishes—such as plates, cups, glasses, etc.—in particular, in household dishwashers. German Utility Model G 88 11 474 U discloses a dish rack for a household dishwasher having a rake-like retaining configuration that has prongs connected to one another. The retaining configuration is mounted such that it can be pivoted about a horizontal axis between different positions. Integrally formed on the retaining configuration are parts that project perpendicularly to the pivot axis, and on both sides of a bearing surface of the retaining configuration, and serve as dish stops for securing cups or similar small items against sliding off.

SUMMARY OF THE INVENTION

It is accordingly an object of the invention to provide a dish rack for accommodating dishes, and household dishwasher that overcomes the hereinafore-mentioned disadvantages of the heretofore-known devices of this general type and that, if required, provides an additional accommodating device, in particular, for hollow dishes.

With the foregoing and other objects in view, there is provided, in accordance with the invention, a dish rack for accommodating dishes, including a dish rack base having a rake-like retaining configuration with prongs, at least part of the rake-like retaining configuration pivotable between different pivot positions, and some of the prongs having angled ends directed toward the dish-rack base.

Taking as departure point a dish rack having a swing-action retaining configuration that includes a plurality of prongs, the subject matter of the invention provides that at the bottom ends of the prongs that are directed toward the dishes-rack base, the prongs of the retaining configuration are angled. By virtue of the prongs, of the already present retaining configuration, with angled ends according to the invention, dishes, in particular hollow dishes—e.g. glasses, vases, cups, bowls and the like—may additionally be accommodated in the dish rack in a straightforward and cost-effective manner. A further advantage of the prongs with angled ends according to the invention is that it is possible for the additional accommodating capacity of the dish rack to be utilized flexibly if required without other configurations having to be installed in the dish rack if it is desired to increase the capacity and to decrease it again when not required.

In accordance with another feature of the invention, the rake-like retaining configuration is pivotable into a horizontal position, a vertical position, and oblique positions different from the horizontal position and the vertical position.

In accordance with a further feature of the invention, at the ends of the prongs, the prongs are angled such that in an oblique retaining-configuration pivot position, which differs from a horizontal or vertical pivot position, they form a set-down surface for hollow dishes. The surface gives more set-down locations for hollow dishes in the dish rack, resulting in a corresponding overall increase in the accommodating capacity. Furthermore, the elegant solution variant—including the combination of the angled prong ends with the oblique pivot position of the retaining configuration—allows the hollow dishes to be accommodated particularly straightforwardly and securely.

In accordance with an added feature of the invention, the angled prongs preferably form the set-down surface in a central position between the horizontal pivot position and the vertical pivot position of the retaining configuration so that the hollow dishes are accommodated as securely as possible.

In accordance with an additional feature of the invention, at their ends, the prongs are angled such that, in an at least more or less horizontal pivot position, they form stops for retaining hollow dishes. The configuration produces more accommodating locations for hollow dishes in the dish rack, resulting in an overall increase in the accommodating capacity. Furthermore, the advantageous solution variant—the prong ends act as stops in the vertical or more or less vertical pivot position of the retaining configuration—allows the hollow dishes to be stood up particularly straightforwardly and securely.

In accordance with yet another feature of the invention, of the prongs, it is preferable for staggered or only every second prong to be angled at its bottom end and be provided as a stop for retaining relatively wide hollow dishes. The configuration has the advantage that additional stand-up locations are available on a flexible basis if required particularly also for wide hollow dishes—e.g. compote dishes, bowls and the like.

In accordance with yet a further features of the invention, the prongs with angled ends are preferably L-shaped or U-shaped. The shape makes it possible for the hollow dishes to be retained particularly securely on the additional set-down surfaces in the oblique pivot position or on the stops of the additional stand-up locations.

In accordance with yet an added feature of the invention, the dish rack is one for a household dishwasher. A household dishwasher that has a dish rack having the features according to the invention provides the possibility of a flexible increase in the accommodating capacity by more set-down surface area and/or stand-up surface area for hollow dishes if required.

In accordance with yet an additional feature of the invention, the dish rack is the top dish rack, the bottom dish rack, or both racks of the dishwasher.

With the objects of the invention in view, there is also provided a dish rack for accommodating dishes, including a rack structure having at least one rake-like retainer, the at least one rake-like retainer having a base wire and prongs attached to and extending from the base wire for securing dishware, the prongs having a free end at a distance from the base wire and an end adjacent the base wire, the at least one rake-like retainer pivotable between different pivot positions, and some of the prongs having an angled end at the end adjacent the base wire.

Other features that are considered as characteristic for the invention are set forth in the appended claims.

Although the invention is illustrated and described herein as embodied in a dish rack for accommodating dishes, and household dishwasher, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
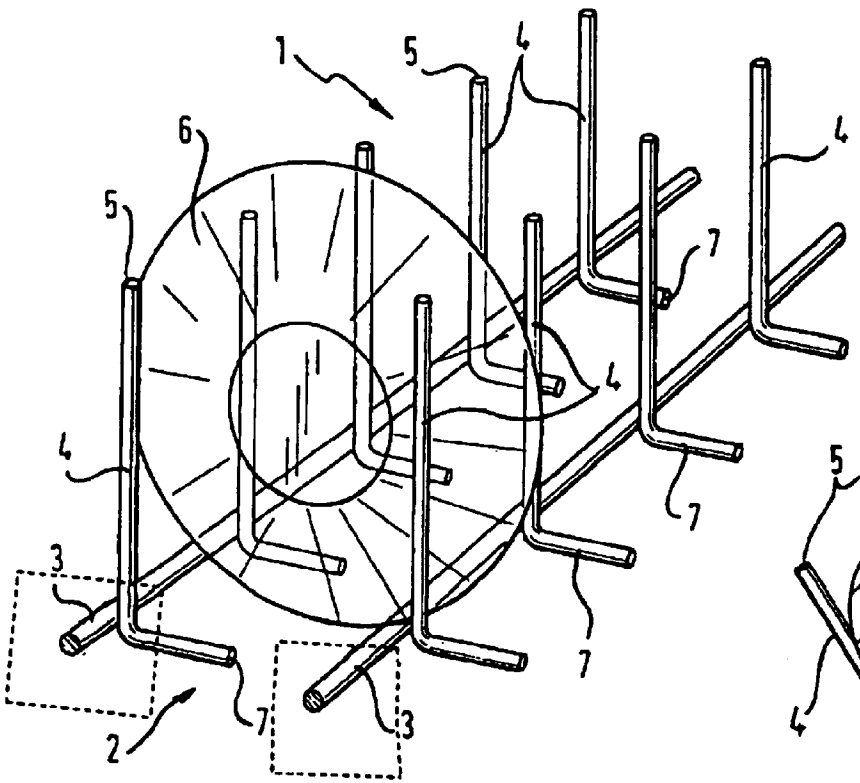
FIG. 1 is a fragmentary, perspective view of part of a dish rack according to the invention for accommodating dishes.

In all the figures of the drawing, sub-features and integral parts that correspond to one another bear the same reference symbol in each case.

A conventional household dishwasher has at least one dish rack. Referring now to the figures of the drawings in detail and first, particularly to FIGS. 1 to 3 thereof, there is shown a part of a dish rack 1. The dish rack 1 can be used both as a top rack and as a bottom rack. The dish rack 1 usually includes a rack structure that is formed by wires and has base wires 3 running longitudinally and transversely on a dish rack base 2. Fastened on the base wires 3 are prongs 4 that are positioned essentially vertically upward and are inclined, if appropriate, in one plane. The prongs 4 serve for securing dishes—usually flat dishes 6 such as plates and the like—that are disposed between the prongs 4 such that they rest on the rack base 2. The prongs 4 are of limited height and have upwardly directed free ends 5.

The prongs 4 form a rake-like retaining configuration that can be swung between different pivot positions. Thus, the retaining configuration has the prongs 4 located in a vertical pivot position in FIG. 1, in a horizontal pivot position in FIG. 3 and in an oblique pivot position, between the horizontal (FIG. 3) and the vertical pivot positions (FIG. 1), in FIG. 2. In relation to the rack base 2, the prongs 4 assume a 90° position when they have been pivoted vertically (FIG. 1), a 0° position when they have been pivoted horizontally (FIG. 3), and, preferably, a 45° position, corresponding to a central position (FIG. 2), when they have been pivoted obliquely.

Figure 2:
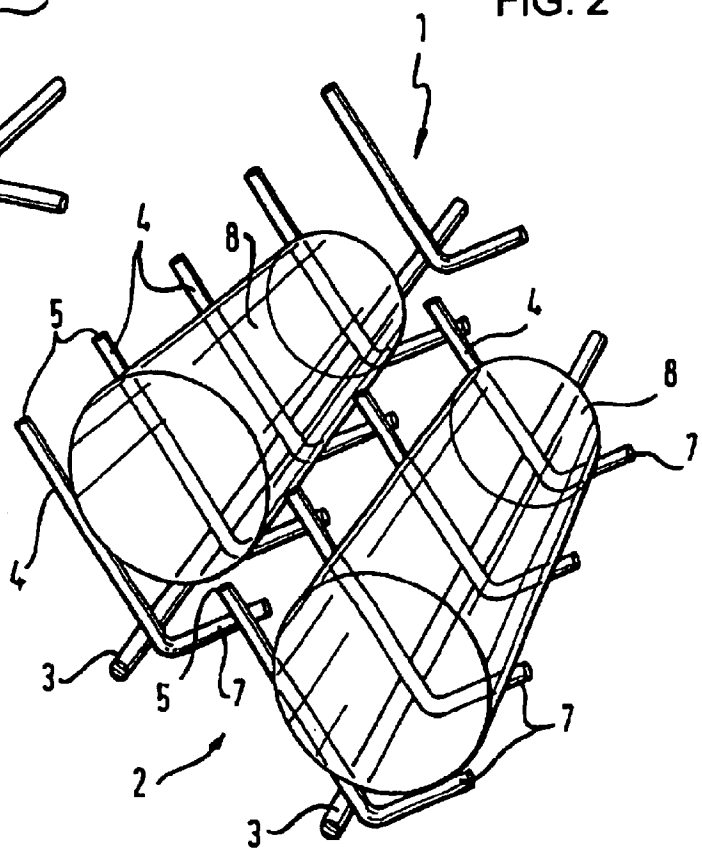
FIG. 2 is a fragmentary, perspective view of the dish rack of FIG. 1.

FIG. 1 illustrates the dish rack 1 for accommodating dishes 6 with a rake-like retaining configuration, in which, according to the invention, at their bottom ends 7, which are directed toward the rack base 2, the prongs 4 are angled. The prongs 4 with the angled ends 7 preferably have an L-shape, but may alternatively have a U-shape. By way of their angled ends 7, a plurality of prongs 4 preferably disposed parallel in the retaining configuration form a set-down surface for dishes, in particular, for hollow dishes. As a result, if required, additional accommodating locations may be made available on a variable basis in the dish rack in a straightforward and cost-effective manner. The advantage is displayed particularly in the illustration of the dish rack 1 according to the invention in FIG. 2, in which, in the oblique position of the rake-like retaining configuration, the prongs 4 with angled ends 7 form a set-down surface for hollow dishes 8, e.g. vessels, tumblers, vases and the like. By virtue of the oblique position—preferably the 45° central position—of the retaining configuration, the hollow dishes 8 rest securely on the angled ends 7 of the prongs 4. See FIG. 2.

Figures 3, 4:
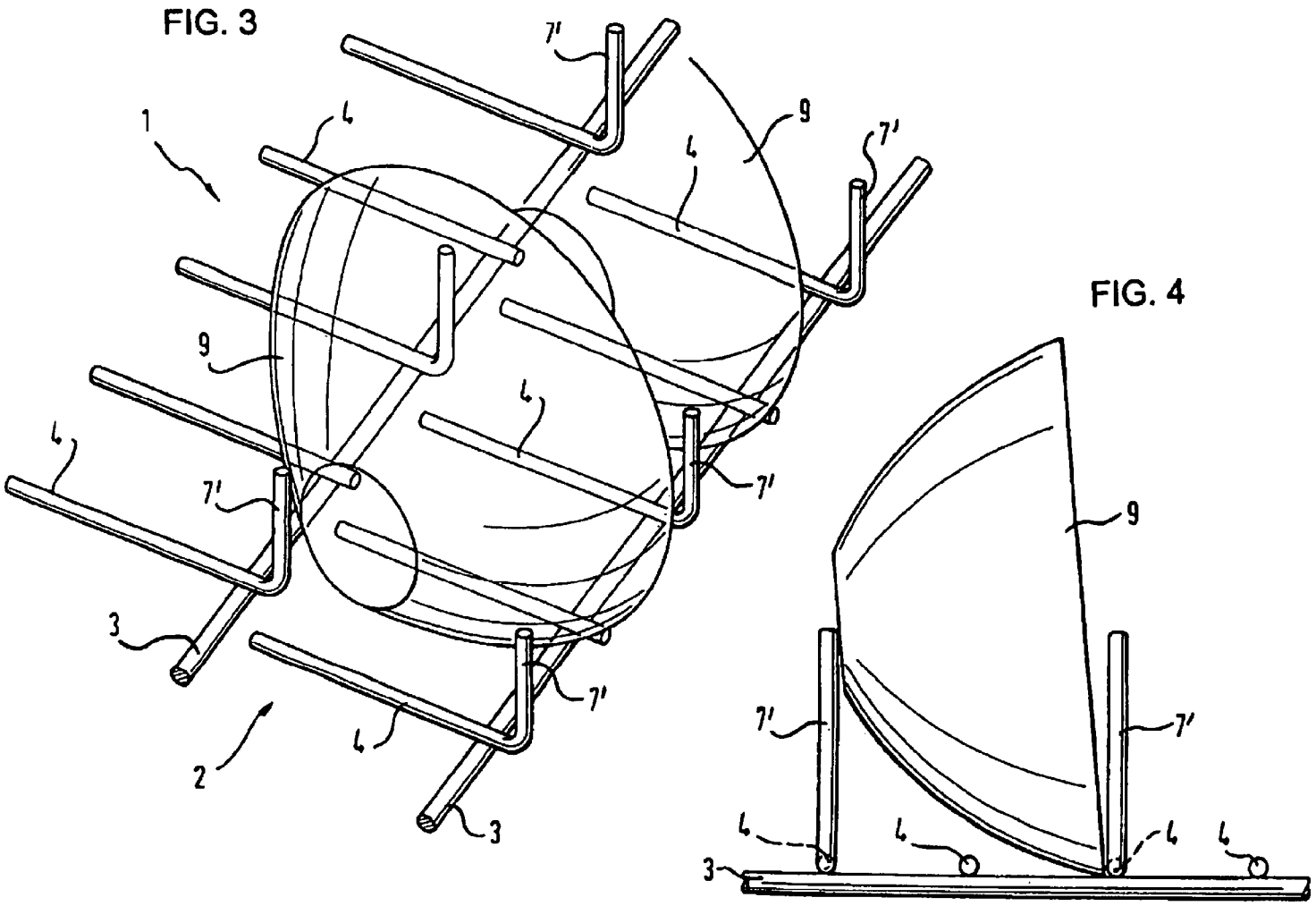
FIG. 3 is a fragmentary, perspective view of the dish rack of FIG. 1 for accommodating very wide dishes.
FIG. 4 is a fragmentary, side elevational view of the dish accommodated in the dish rack according to FIG. 3.

FIG. 3 shows a further variant of the dish rack 2 for accommodating, in particular, relatively wide dishes 9, e.g. compote dishes, salad bowls, and the like. The rake-like retaining configuration has the prongs 4 with angled ends 7 according to the invention located in the horizontal pivot position, corresponding to the 0° position of the prongs 4 in relation to the rack base 2. The ends 7' of the angled prongs 4 project essentially vertically upward in this pivot position and, thus, form stops for retaining the hollow dishes 9. According to a preferred configuration of the dish rack 2, of a plurality of prongs 4 in a prong row, only every second prong 4 is angled at its bottom end 7', in particular, to retain relatively wide hollow dishes 9 as a stop. The configuration is clearly shown in FIG. 4 by a side view of a hollow dish 9. The hollow dish 9 is retained between two stops that, when the retaining configuration is laid flat in the 0° position, are formed by the adjacent ends 7' of two angled prongs 4. The prong 4 disposed between the two prongs 4 with angled ends 7' does not have an L-shaped extension, which achieves a larger width for the additionally provided stand-up location for accommodating a compote dish 9 or a salad bowl.

As a result of the dish rack having prongs with angled ends that are directed toward the rack base 2, it is possible to make available, on a flexible basis, additional set-down surfaces in the oblique pivot position or additional stand-up locations with stops in the horizontal pivot position. The stops are suitable, if required, for retaining, in particular, hollow dishes.

I claim:

1. A dish rack for accommodating dishes, comprising:

a plurality of base wires forming a dish rack base; and a plurality of prongs each having two legs with two free ends and an intersection connecting said legs to one another, each of said prongs being connected to a respective one of said base wires in a vicinity of said intersection, and distal from said free ends, and at least some of salt prongs being pivotable between different pivot positions about a respective longitudinal axis of one of said base wires.

2. The dish rack according to claim 1, wherein at least some of said legs are pivotable into a horizontal position, a vertical position, and oblique positions different from said horizontal position and said vertical position.

3. The dish rack according to claim 2, wherein at least some of said legs form a set-down surface for hollow dishes when at least some of said legs are pivoted into at least one of said oblique positions.

4. The dish rack according to claim 2, wherein at least some of said legs form a set-down surface when at least some of said legs are pivoted into an oblique position half-way between said horizontal position and said vertical position.

5. The dish rack according to claim 2, wherein at least some of said legs form stops for retaining hollow dishes in said horizontal position.

6. The dish rack according to claim 2, wherein at least some of said legs form stops for retaining hollow dishes in at least one of said oblique positions.

7. The dish rack according to claim 1, further comprising:

further prongs having one leg;

said further prongs and said prongs being alternating disposed on said base wire; and said two legs of said prongs forming a step for retaining hollow dishes.

8. The dish rack according to claim 1, wherein some of said prongs are pivotable into three functional dish rack positions, including:

a first functional dish rack position in which a first one of said legs is substantially perpendicular to a plane defined by said dish rack base and a second one of said legs is substantially parallel to said plane;

a second functional dish rack position in which said first and second legs enclose acute angles with said plane; and a third functional dish rack position in which said first leg is substantially parallel to said plane and said second leg is substantially perpendicular to said plane.

9. The dish rack according to claim 8, further comprising;

further prongs having one leg;

said further prongs and said prongs being alternating disposed on said base wire; and said two legs of said prongs forming a stop for retaining hollow dishes.

10. The dish rack according to claim 1, wherein said prongs having two legs are L-shaped.

11. A dish rack for accommodating dishes, comprising:

at least one base wire and a plurality of prongs forming a retainer;

said plurality of prongs each having two legs and an intersection connecting said legs to one another, each of said prongs being connected to said base wire in a vicinity of said intersection and distal from said free ends, for securing dishware, and at least some of said prongs being pivotable between different pivot positions about longitudinal axis of said base wire.

12. The dish rack according to claim 11, wherein said prongs having two legs are L-shaped.

13. The dish rack according to claim 12, wherein said retainer is pivotable into a horizontal position, a vertical position, and oblique positions different from said horizontal position and said vertical position.

14. The dish rack according to claim 13, wherein a least one of said leg forms a set-down surface for hollow dishes when said retainer is pivoted into at least one of said oblique positions.

15. The dish rack according to claim 13, wherein at least one of said legs forms a stop for retaining hollow dishes in at least one of said horizontal position and said oblique positions.

16. The dish rack according to claim 11, further comprising:

further prongs having one leg;

said further prongs and said prongs being alternating disposed on said base wire; and said two legs of said prongs forming a stop for retaining hollow dishes.

17. In a household dishwasher, a dish rack for accommodating dishes, the dish rack comprising:

a plurality of base wires forming a dish rack base; and a plurality of prongs each having two legs with two free ends and an intersection connecting said legs to one another, each of said prongs being connected to a respective one of said base wires in a vicinity of said intersection, and distal from said free ends, and at least some of said prongs being pivotable between different pivot positions about a respective longitudinal axis of one of said base wires.

* * * * *